US010082051B2

(12) United States Patent
Tanaka et al.

(10) Patent No.: US 10,082,051 B2
(45) Date of Patent: Sep. 25, 2018

(54) OVERHEAD VALVE ACTUATION MECHANISM FOR ENGINE

(71) Applicant: SUZUKI MOTOR CORPORATION, Hamamatsu-Shi, Shizuoka (JP)

(72) Inventors: Koichi Tanaka, Hamamatsu (JP); Kunio Arase, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 15/677,823

(22) Filed: Aug. 15, 2017

(65) Prior Publication Data

US 2018/0058268 A1 Mar. 1, 2018

(30) Foreign Application Priority Data

Aug. 29, 2016 (JP) ..... 2016-167199

(51) Int. Cl.

| | |
|---|---|
| ***F01L 1/34*** | (2006.01) |
| ***F01L 1/18*** | (2006.01) |
| ***F01L 1/053*** | (2006.01) |
| ***F01L 1/08*** | (2006.01) |
| ***F01L 1/46*** | (2006.01) |

(52) U.S. Cl.

CPC ..... *F01L 1/18* (2013.01); *F01L 1/053* (2013.01); *F01L 1/08* (2013.01); *F01L 1/46* (2013.01)

(58) Field of Classification Search

CPC ..... F01L 1/18; F01L 1/053; F01L 1/08; F01L 1/46

See application file for complete search history.

(56) References Cited

U.S. PATENT DOCUMENTS 8,499,740 B2 * 8/2013 Yoon ..... F01L 1/181 123/321

2009/0241891 A1 10/2009 Tsubakino et al.

FOREIGN PATENT DOCUMENTS

JP 2009243401 A 10/2009

* cited by examiner

*Primary Examiner* — Zelalem Eshete

(74) *Attorney, Agent, or Firm* — Troutman Sanders LLP

(57) ABSTRACT

A rocker arm includes a pivot portion that is journaled by a rocker arm shaft, a contact portion that projects from the pivot portion to a side of a valve cam, and a pressing portion that projects from the pivot portion to a side of a valve. While including a slipper projecting from the pivot portion in outer side in an axial direction to a side of a camshaft, an overhead valve actuation mechanism for the engine includes a stopper portion with which the slipper comes in contact when the rocker arm swings and reaches a predetermined position at a position opposing the slipper.

8 Claims, 12 Drawing Sheets

14
10
19
17
13
12
11
15
Fr
Rr
UPPER
FRONT

OVERHEAD VALVE ACTUATION MECHANISM FOR ENGINE

CROSS-REFERENCE TO RELATED APPLICATIONS

This application is based upon and claims the benefit of priority of the prior Japanese Patent Application No. 2016-167199, filed on Aug. 29, 2016, the entire contents of which are incorporated herein by reference.

BACKGROUND OF THE INVENTION

Field of the Invention

The present invention relates to a preferable overhead valve actuation mechanism used for an engine mounted on a vehicle, such as a motorcycle.

Description of the Related Art

Conventionally, for example as described in Patent Document 1, a valve gear includes a rocker shaft and a rocker arm. The rocker shaft has an axis line parallel to a camshaft. The rocker shaft is disposed at a position projecting from a coupling face as viewed from an axial direction of the camshaft and supported by the cylinder head. The rocker arm is turnably borne by the rocker shaft so as to swing following a rotation of an air exhaust side valve motion cam disposed in the camshaft.

Patent Document 1: Japanese Laid-open Patent Publication No. 2009-243401

With a conventional valve gear, there is a case in which what is called a valve jump is generated. The valve jump is a phenomenon in which a rocker arm separates from a cam lobe of a valve cam due to an inertia force of the valve gear becoming larger than a reactive force of a valve spring when the number of revolution of an engine increases to a set number of revolution or more. When this valve jump phenomenon is generated, the valve gear, such as a valve and the rocker arm, unstably behaves to make it hard to guarantee a proper valve operation.

SUMMARY OF THE INVENTION

Considering the above-described problems, one of the objectives of the present invention is to provide an overhead valve actuation mechanism for an engine that ensures a proper operation of a valve gear even when the engine is in a high revolution.

An overhead valve actuation mechanism for an engine of the present invention includes a camshaft, a rocker arm, and a rocker arm shaft. The camshaft is rotatably supported by a cylinder head, includes one or a plurality of valve cams, and operates opening and closing of an air intake side or air exhaust side valve via the valve cam. The rocker arm is swung by the valve cam of the camshaft and acts on the valve to open and close the valve. The rocker arm shaft is supported by the cylinder head and swingably supports the rocker arm. The rocker arm includes a pivot portion, a contact portion, a pressing portion, and a slipper. The pivot portion is journaled by the rocker arm shaft and serves as a swing center. The contact portion projects from this pivot portion to a side of the valve cam and receives a pressure from the valve cam. The pressing portion projects from the pivot portion to a side of the valve and presses the valve in swinging by coming in contact with a top portion of the valve. The slipper projects from the pivot portion in an outer side in an axial direction to a side of the camshaft. On the other hand, the camshaft includes a stopper cam at a position opposing the slipper. The stopper cam includes a stopper portion with which the slipper comes in contact when the rocker arm swings and reaches a predetermined position.

DETAILED DESCRIPTION OF THE PREFERRED EMBODIMENTS

The following describes preferable embodiments for an overhead valve actuation mechanism for an engine according to the present invention based on the drawings.

Figure 1:
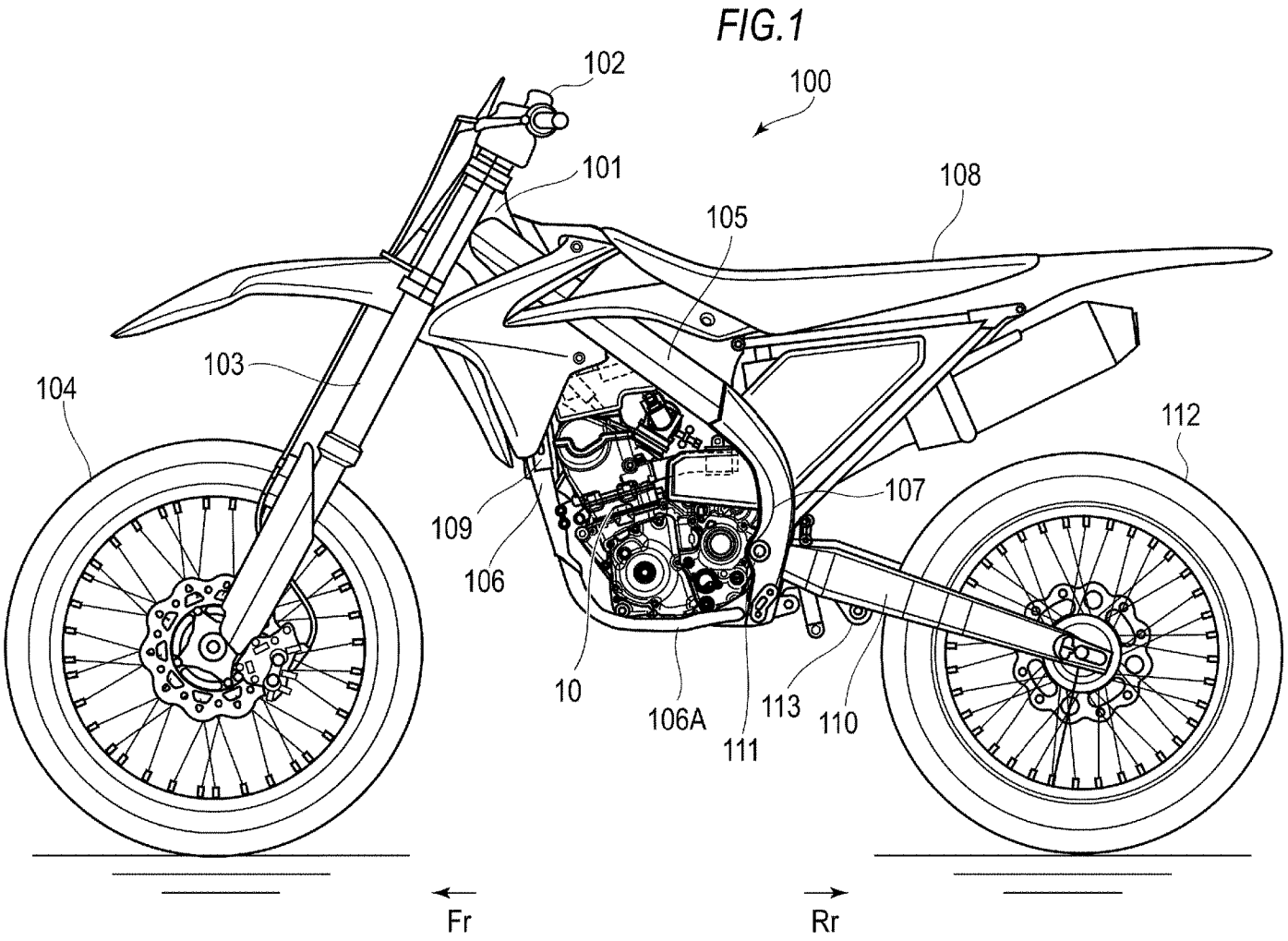
FIG. 1 is a left side view of a motorcycle according to an embodiment of the present invention.

The present invention is preferably applied for the engine mounted on a motorcycle or similar vehicle. In this embodiment, a motorcycle 100 illustrated in FIG. 1 is an example. FIG. 1 is a left side view of the motorcycle 100 according to the embodiment. First, an overall configuration of the motorcycle 100 will be described with reference to FIG. 1. Here, in the respective drawings including FIG. 1 used in the following description, as necessary, the front side of a vehicle is indicated by an arrow Fr and the rear side of the vehicle is indicated by an arrow Rr. The lateral right side of the vehicle is indicated by an arrow R and the lateral left side of the vehicle is indicated by an arrow L.

The motorcycle 100 in FIG. 1 may typically be, what is called for off-road. The motorcycle 100 includes a steering head pipe 101 disposed on an upper portion of a front side of the vehicle body, and a steering shaft (not illustrated) is turnably inserted into the steering head pipe 101. Then, the steering shaft includes an upper end on which a handlebar 102 is firmly attached and a lower end on which a front fork 103 is mounted. The front fork 103 includes a lower end to which a front wheel 104 as a steering wheel is rotatably journaled.

From the steering head pipe 101, a main frame 105 composed of a pair of right and left parts extends to a rear of the vehicle body inclining obliquely downward, and a down tube 106 extends downward approximately vertical. Then, the down tube 106 is branched to right and left near a lower portion as lower frames 106A, and the pair of lower frames 106A extend downward to be bent to the rear of the vehicle body at an approximately right angle. The pair of lower frames 106A includes rear end portions coupled to each rear end portion of the main frame 105 via a pair of right and left body frames 107.

In a space surrounded by the pairs of right and left main frames 105, the down tube 106 and the lower frames 106A, and the body frames 107, a water-cooled engine 10 as a driving source is mounted. An air cleaner, a fuel tank, or similar component is disposed above the engine 10 as described later, and a seat 108 is disposed in a front-rear direction at the upper portion of the vehicle body. A radiator 109 is disposed ahead of the engine 10.

On the pair of right and left body frames 107 disposed on the lower portion of the approximately center of the vehicle body in the front-rear direction, front end portions of swing arms 110 are supported swingable in a vertical direction by a pivot shaft 111. The swing arm 110 includes a rear end portion to which a rear wheel 112 as a driving wheel is rotatably journaled. While detailed illustrations are omitted, the swing arm 110 is suspended on the vehicle body via a link mechanism 113 and a shock absorber (rear wheel suspension device) coupled to the link mechanism 113. The engine 10 disposed ahead of the swing arm 110 includes an output end on which a drive sprocket is mounted, and the rear wheel 112 includes a wheel axis on which a sprocket is pivotably supported. A chain is wound around the drive sprocket and the sprocket to couple to one another.

Figure 2:
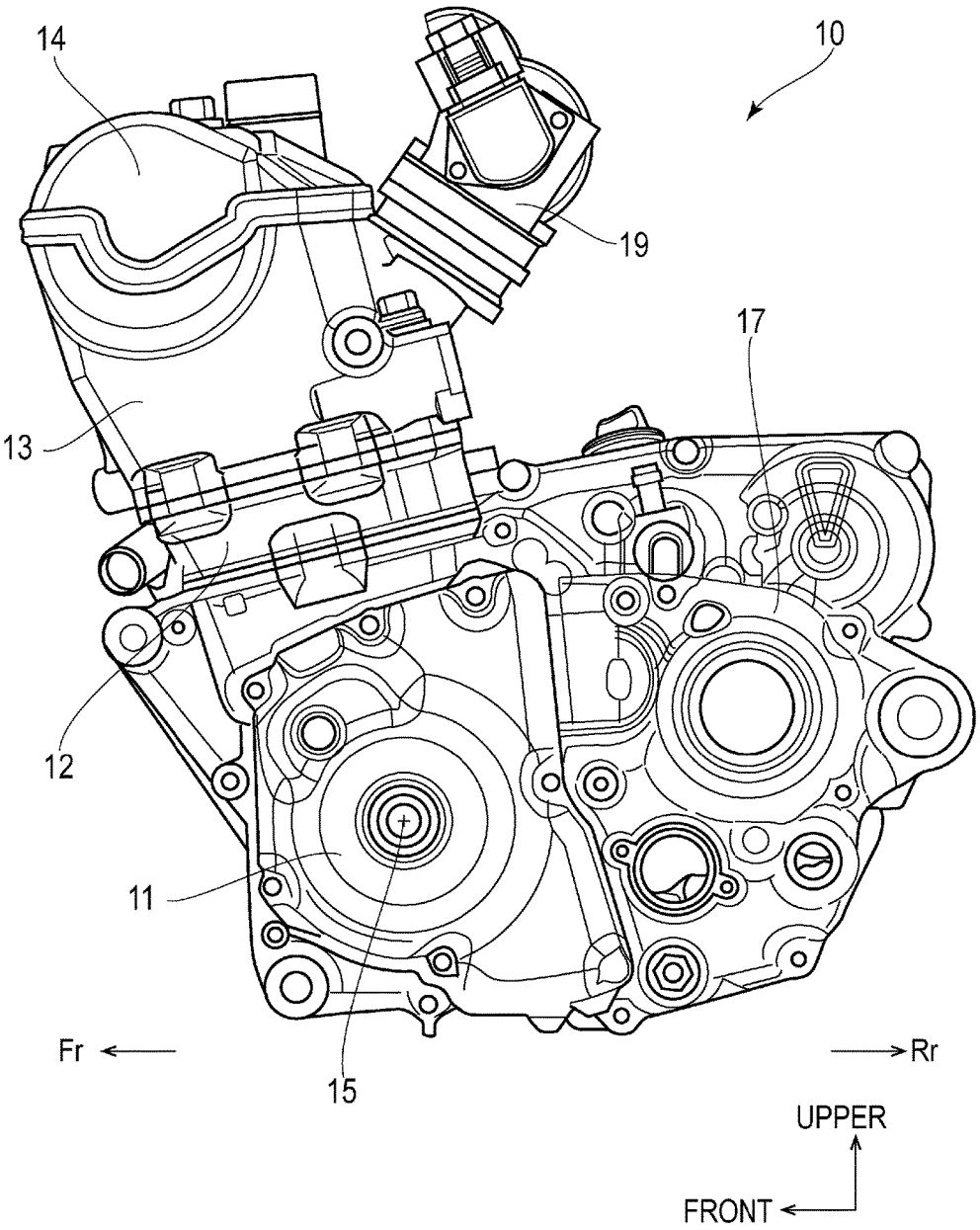
FIG. 2 is a left side view of an engine of the motorcycle according to the embodiment of the present invention.

The overhead valve actuation mechanism for the engine of the present invention is applied for the engine mounted on a vehicle, such as such motorcycle 100. FIG. 2 is a left side view of the engine 10 of, for example, a motorcycle as an application example of the embodiment. First, an overall configuration of the engine 10 will be described with reference to FIG. 2. Here, in the respective drawings including FIG. 2 used in the following description, as necessary, the front side of a vehicle is indicated by an arrow Fr and the rear side of the vehicle is indicated by an arrow Rr. The lateral right side of the vehicle is indicated by an arrow R and the lateral left side of the vehicle is indicated by an arrow L.

Figure 6:
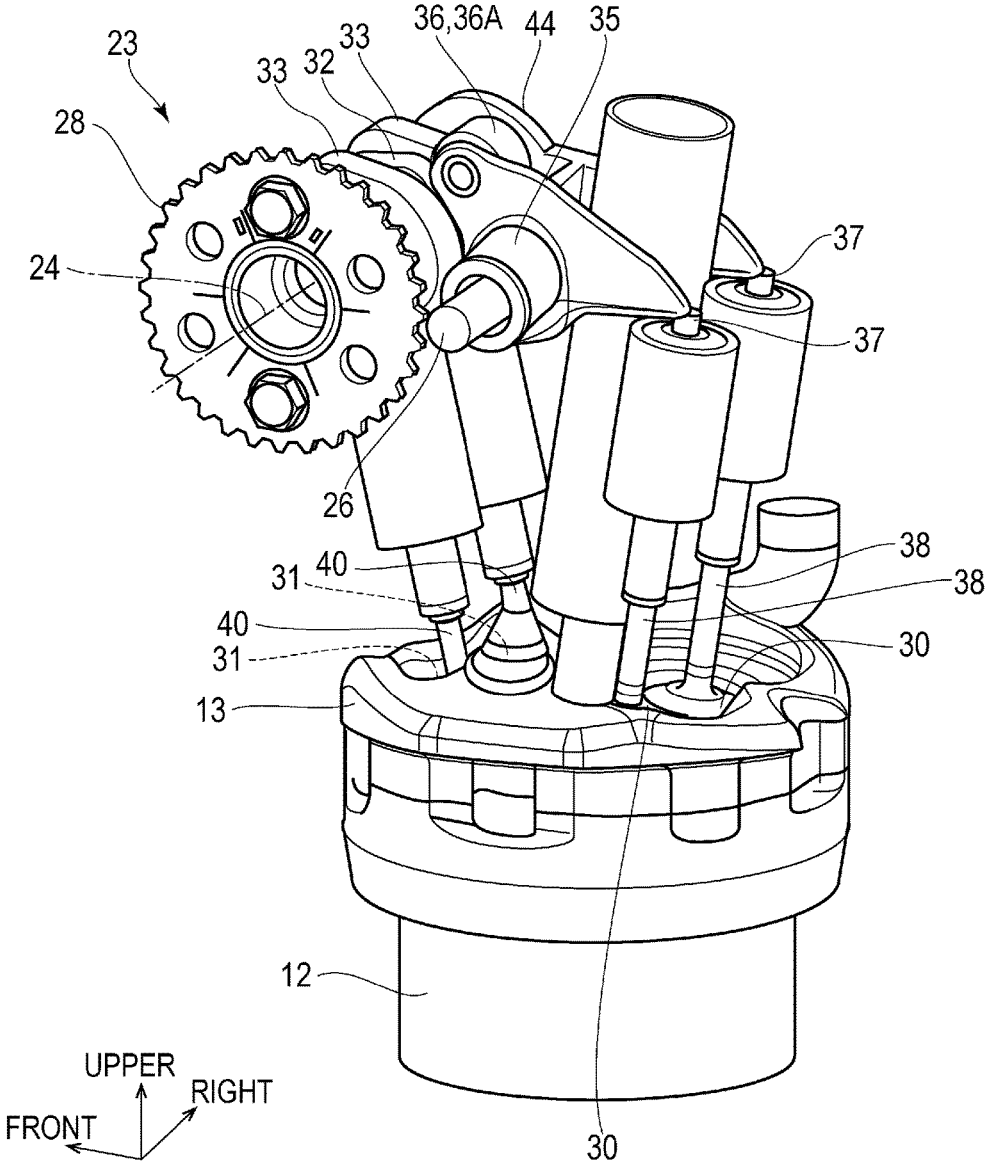
FIG. 6 is a perspective view illustrating an exemplary configuration around the cylinder head where an overhead valve actuation mechanism of the present invention is disposed.

The engine 10 may be, for example, a single cylinder SOHC gasoline engine. In this embodiment, what is called a four valve engine, which includes two intake valves 30 and two exhaust valves 31, is an example (see FIG. 6). In a basic configuration of the engine 10 in FIG. 2, a cylinder block 12, a cylinder head 13, and a cylinder head cover 14 are integrally joined together in order above a crankcase 11. A cylinder axis line Z is oriented in an approximately vertical direction. In a crank chamber of the crankcase 11, a crankshaft 15 (in FIG. 2, briefly illustrated with the axis line of the crankshaft 15) is rotatably journaled. On the other hand, while the illustrations are omitted, a piston is fitted movable in the cylinder axis line Z direction inside a cylinder bore 16 (see FIG. 4) of the cylinder block 12. A crank pin of the crankshaft 15 and a piston pin of the piston are mutually coupled via a connecting rod. The piston reciprocating along the cylinder axis line Z direction inside the cylinder bore 16 rotatably drives the crankshaft 15.

In the rear portion of the crankcase 11, a transmission case 17 is integrally joined together. While the illustrations are omitted, inside this transmission case 17, a transmission configured as a multistage transmission system is disposed. The crankshaft 15 disposed inside the crankcase 11 and the transmission are mutually coupled. An output of the engine 10 is transmitted to the drive sprocket, which is a final output end, in a state where the output is changed to a desired transmission ratio via the transmission.

The engine 10 includes, while the illustrations are omitted, an air intake system, which supplies a clean air (intake air) supplied from the air cleaner, a fuel system, which supplies a fuel from a fuel supply device, and an exhaust system, which discharges an exhaust gas after burning inside the cylinder from the engine 10. The engine 10 also includes a valve system, which drivingly controls an intake valve and an exhaust valve of the air intake system and the exhaust system, respectively, a cooling system, which cools down the engine 10, and a lubricating system, which lubricates movable parts of the engine 10. Furthermore, a control system (ECU; Engine Control Unit), which properly controls operations of each of these systems in accordance with a predetermined sequence, is attached. The control of the control system causes a plurality of function systems to collaborate with the above-described auxiliary machines and similar machine. In view of this, a smooth operation is executed as the whole engine 10.

Figure 3:
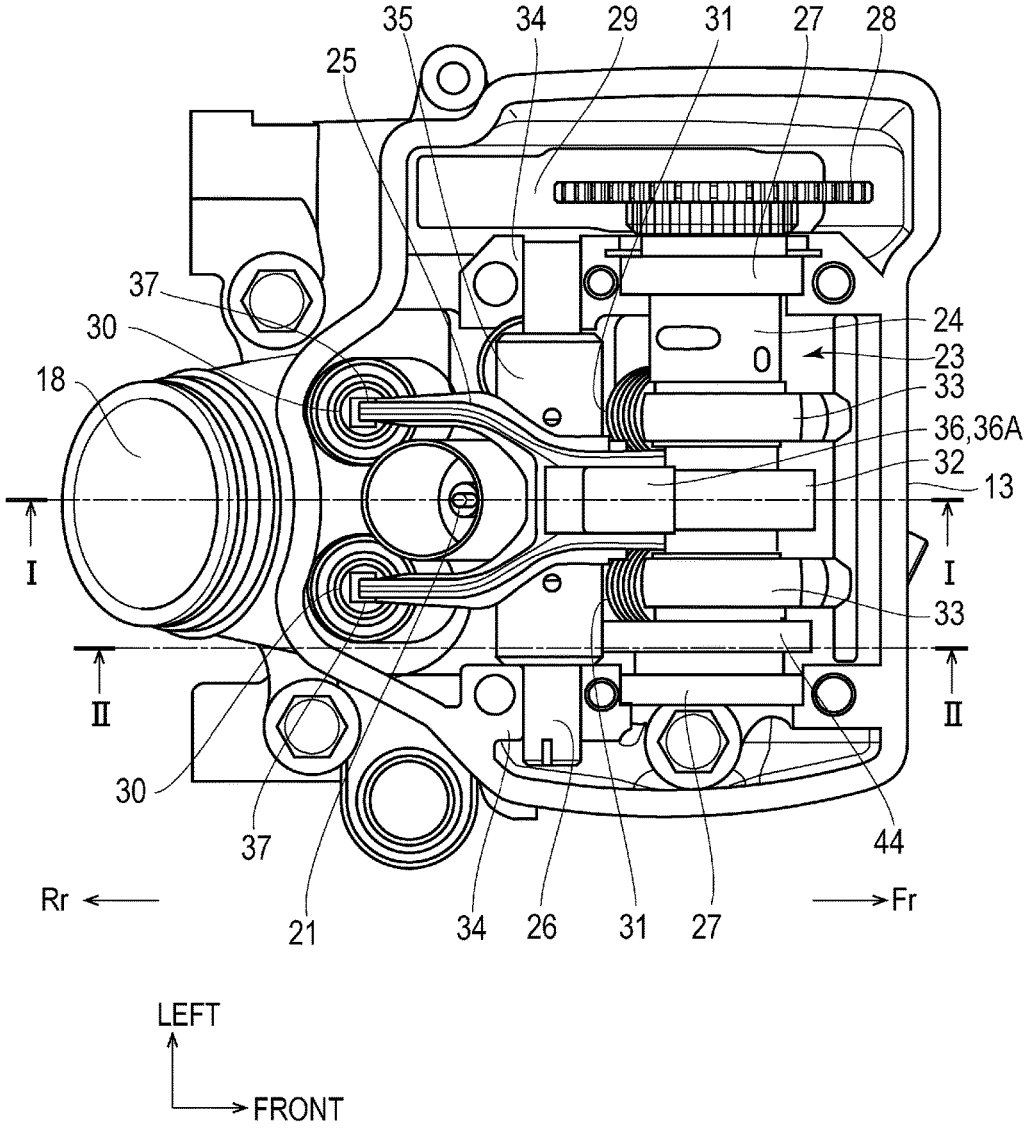
FIG. 3 is a drawing around a cylinder head viewed from above where a cylinder head cover is removed in the embodiment of the present invention.
Figure 4:
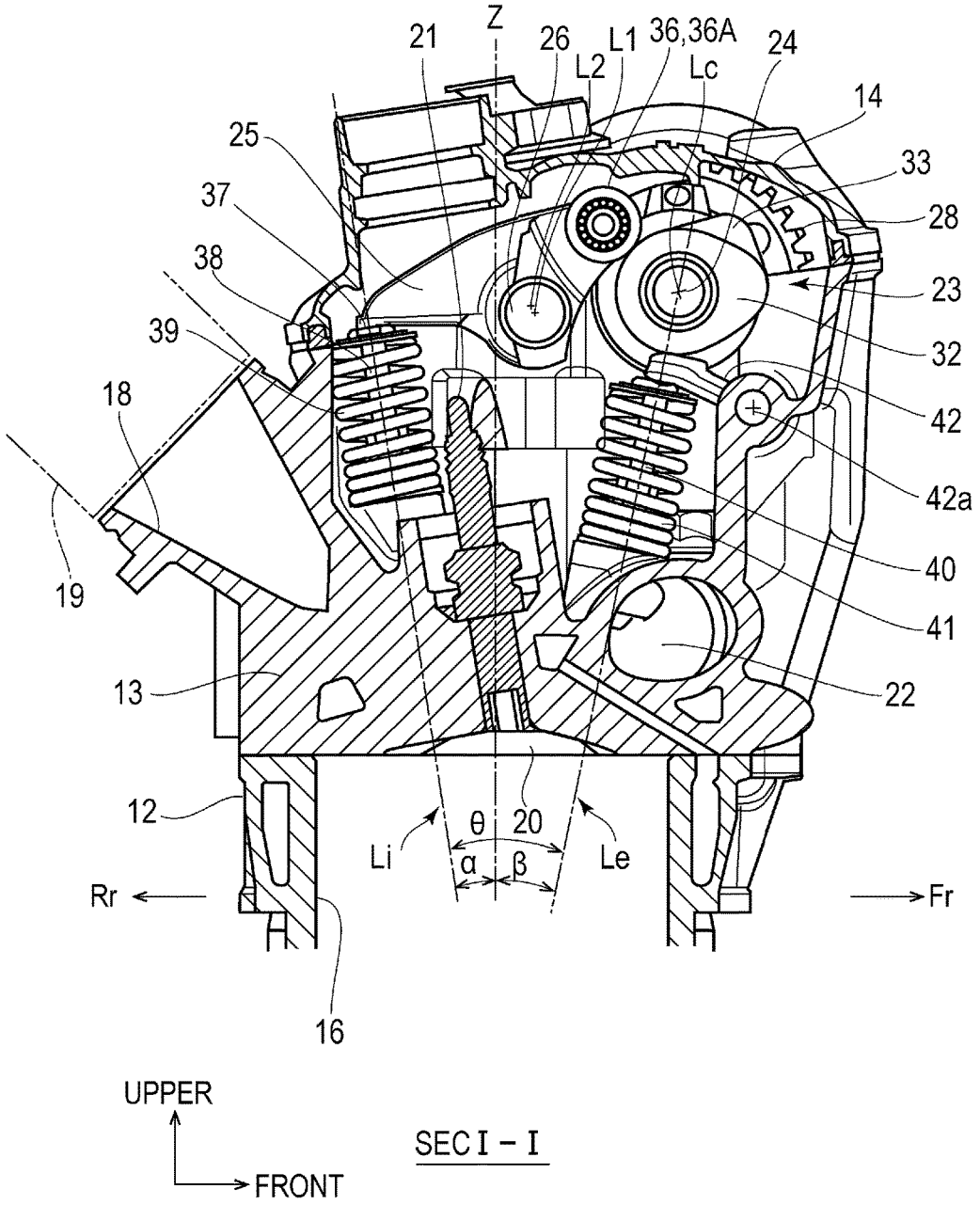
FIG. 4 is a cross-sectional view taken along a line I-I in FIG. 3.
Figure 5:
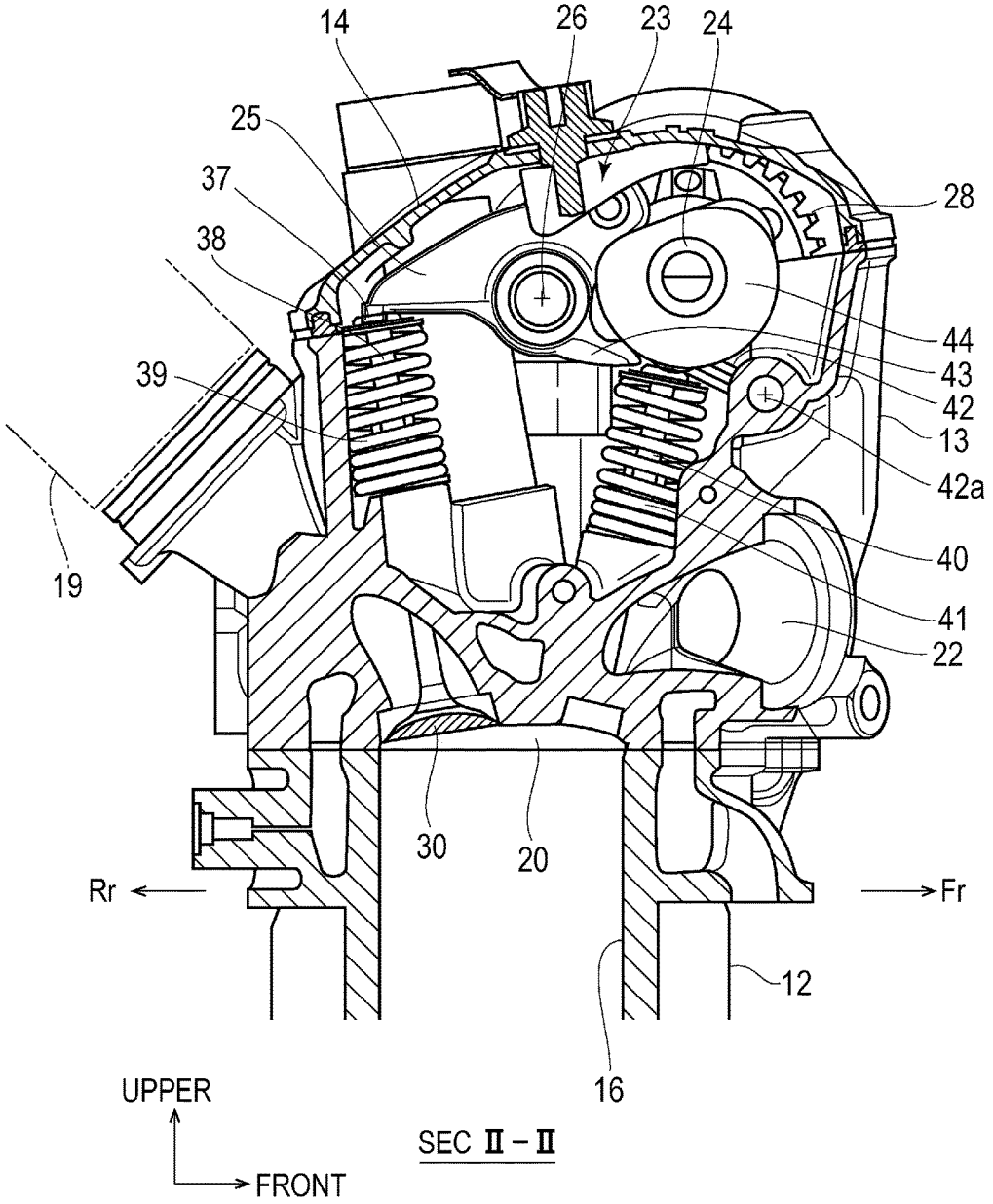
FIG. 5 is a cross-sectional view taken along a line II-II in FIG. 3.

FIG. 3 is a drawing around the cylinder head 13 viewed from above where the cylinder head cover 14 is removed. FIG. 4 is a cross-sectional view taken along a line I-I in FIG. 3. FIG. 5 is a cross-sectional view taken along a line II-II in FIG. 3. In the air intake system of the engine 10, an intake port 18 opens in a rear side of the cylinder head 13 in this example. A purified air is supplied from the air cleaner to the intake port 18 via a throttle valve. To this intake port 18, a throttle body 19 (see, for example, FIG. 2) is coupled. The throttle body 19 internally includes an intake passage that is opened and closed by the throttle valve, and an intake flow amount is controlled. In a downstream side of the throttle valve, an injector for fuel injection is fitted. The fuel in the fuel tank in the fuel system is supplied to the injector with a fuel pump. An air-fuel mixture made by mixing the air and the fuel passes the intake port 18 and then flows into a combustion chamber 20 (see FIG. 4). A spark plug 21 is fitted to the combustion chamber 20. The spark plug 21 ignites the air-fuel mixture, and the air-fuel mixture burns and explodes inside the combustion chamber 20.

In the exhaust system, an exhaust port 22 opens in a front side of the cylinder head 13 in this example. This exhaust port 22 communicates with the combustion chamber 20. The air-fuel mixture burnt and exploded inside the combustion chamber 20 is discharged as the exhaust gas from the engine 10 via the exhaust port 22.

In this example, a diameter of the intake port 18, which opens in the rear side of the cylinder head 13, is formed larger than a diameter of the exhaust port 22, which opens in the front side of the cylinder head 13.

In the cylinder head 13, as illustrated in FIG. 3, an overhead valve actuation mechanism 23 according to the present invention is disposed. The overhead valve actuation mechanism 23 configures the valve system of the engine 10. In a basic configuration, the overhead valve actuation mechanism 23 includes a camshaft 24, rocker arms 25, and a rocker arm shaft 26. The camshaft 24 is rotatably supported by the cylinder head 13 and includes one or a plurality of valve cams. The camshaft 24 opens and closes valves in the air intake side or the air exhaust side via this valve cam. The rocker arms 25 are swung by the valve cam of the camshaft 24 and act on the valves to perform opening and closing operations. The rocker arm shaft 26 is supported by the cylinder head 13 and swingably supports the rocker arms 25.

The camshaft 24, in this example, is horizontally disposed in a right-left direction in a state of being biased to the discharge side of the cylinder head 13, that is, in the front side of the cylinder head 13, and is rotatably supported by bearings 27 at both ends on the right and left of the camshaft 24. As a driving mechanism of the camshaft 24, a cam sprocket 28 is installed on a left shaft end portion of the camshaft 24. This cam sprocket 28 is coupled to the crankshaft 15 via a cam timing chain (not illustrated). In this case, the drive sprocket is installed on a left side shaft end portion of the crankshaft 15. The cam timing chain is wound around and installed in a predetermined manner between this drive sprocket and the cam sprocket 28. This cam timing chain runs by being driven by the crankshaft 15 as a driving source inside a cam timing chain chamber 29. This rotatably drives the camshaft 24 synchronizing with the crankshaft 15.

On the camshaft 24, a single air intake side valve cam 32 and a pair of air exhaust side valve cams 33 that are disposed at both right and left sides of the air intake side valve cam 32 are disposed so as to integrally rotate. In this example, the intake valve 30 is applied with a rocker arm drive system. That is, the rocker arms 25 and the rocker arm shaft 26 that swingably supports the rocker arms 25 are provided. The rocker arm shaft 26 is, as illustrated in, for example, FIGS. 3 and 4, disposed in the rear side of the camshaft 24 at a height position approximately identical to that of the camshaft 24. Fixed shaft portions 26*a* disposed at both the right and left ends of the rocker arm shaft 26 are supported by the cylinder head 13 via journal portions 34.

The rocker arms 25 include a pivot portion 35, a contact portion 36, and pressing portions 37. The pivot portion 35 is rotatably journaled by the rocker arm shaft 26 and serves as a swing center. The contact portion 36 projects from the pivot portion 35 to a side of the air intake side valve cam 32 to receive a pressure from the air intake side valve cam 32. The pressing portions 37 project in an arm shape from the pivot portion 35 to a side of the intake valves 30 to contact top portions of these intake valves 30 and press the intake valves 30 in swinging.

The contact portion 36 is constituted of a tappet roller 36A rotatably installed at an end portion of the rocker arms 25 in the air exhaust side.

As illustrated in FIG. 3, the pressing portions 37 are oriented toward the two intake valves 30. The pressing portions 37 extend branching in a forked shape from the pivot portion 35. The pressing portions 37 have the respective distal ends abutting on upper end portions of intake valve stems 38 of the intake valves 30.

The intake valve 30 is configured to reciprocate in the axial direction together with the intake valve stem 38 (see, for example, FIG. 6) by the intake valve stem 38 being guided by a valve guide. While detailed illustrations are omitted, the intake valve stem 38 is always biased upward by the elastic force of an intake valve spring 39 fitted between spring seats on a top and a bottom. The pressing portions 37 pressing down the intake valve stems 38 against the elastic force of the intake valve springs 39 biases the intake valve stems 38 downward, that is, causes the intake valves 30 to open.

In this example, the exhaust valve 31 is applied with a direct drive system, that is, the exhaust valve 31 is directly driven substantially by the air exhaust side valve cam 33.

The exhaust valve 31 reciprocates in the axial direction together with an exhaust valve stem 40 by the exhaust valve stem 40 being guided by a valve guide. While detailed illustrations are omitted, the exhaust valve stem 40 is always biased upward by the elastic force of an exhaust valve spring 41 fitted between spring seats on a top and a bottom. The air exhaust side valve cams 33 pressing down the exhaust valve stems 40 against the elastic force of the exhaust valve springs 41 biases the exhaust valve stems 40 downward, that is, causes the exhaust valves 31 to open.

With reference to FIG. 4, between the air exhaust side valve cam 33 and an upper end portion of the exhaust valve stem 40, a finger follower 42 that is swingably supported by the cylinder head 13 via a spindle 42*a* is disposed. The air exhaust side valve cams 33 pressing the finger followers 42 causes the exhaust valve stems 40 to be pressed down.

In this example, as described above, the diameter of the intake port 18 is formed to be larger than the diameter of the exhaust port 22. Corresponding to this, the intake valves 30 are formed to be in diameters larger than those of the exhaust valves 31.

In a basic operation of the overhead valve actuation mechanism 23, the above-mentioned cam timing chain running inside the cam timing chain chamber 29 rotatably drives the camshaft 24 synchronizing with the rotation of the crankshaft 15 inside the cylinder head 13. In view of this, the air intake side valve cam 32 and the air exhaust side valve cams 33 of the camshaft 24 drive the intake valves 30 and the exhaust valves 31, respectively, for opening and closing at a predetermined timing.

Figure 7:
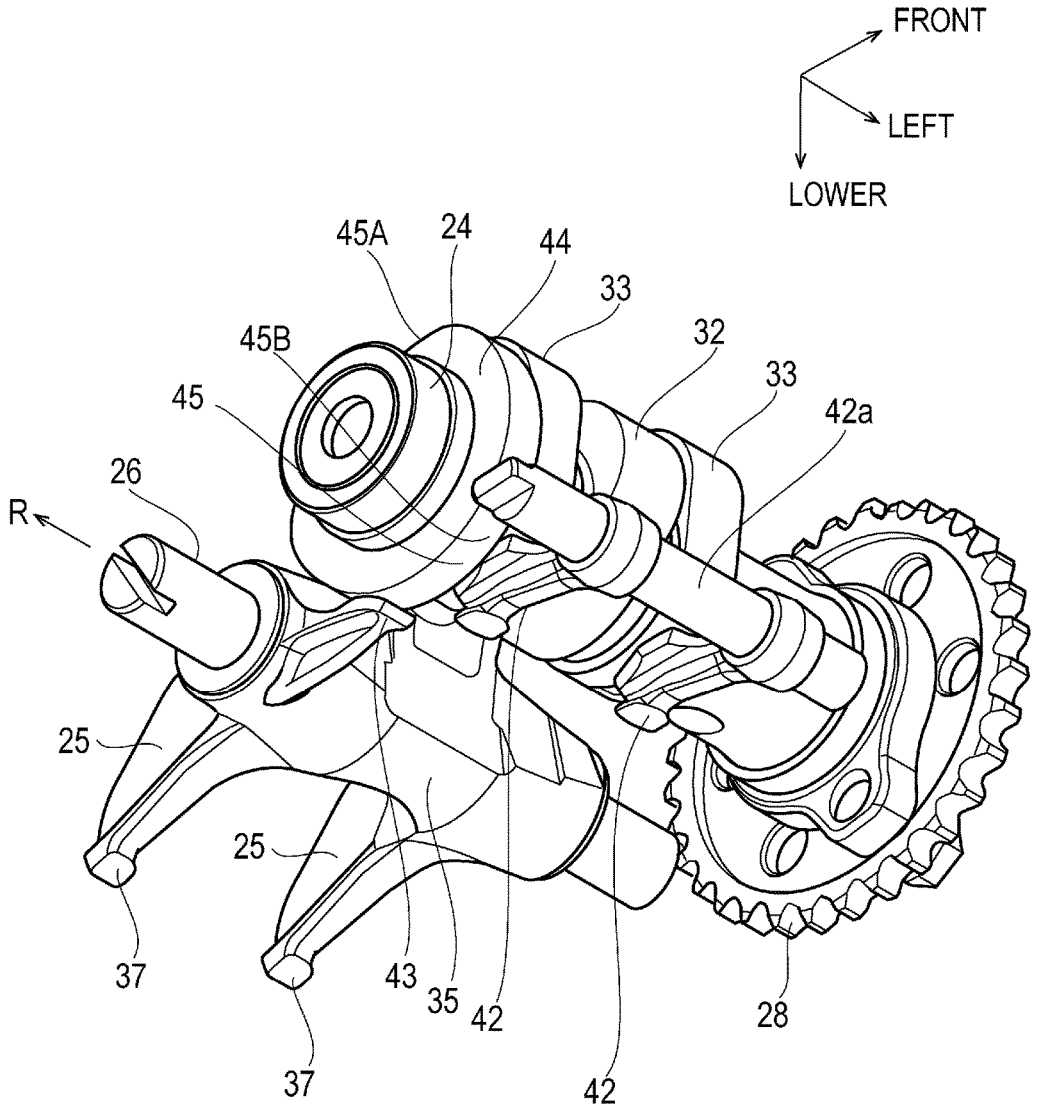
FIG. 7 is a downward perspective view illustrating a main part according to the overhead valve actuation mechanism of the present invention.

In the overhead valve actuation mechanism 23 of the present invention, as illustrated in, for example, FIG. 7, the rocker arms 25 include a slipper 43 that projects from the pivot portion 35 in outer side in the axial direction to the camshaft 24 side. On the other hand, the camshaft 24 includes a stopper cam 44 at a position opposing the slipper 43.

Figure 8:
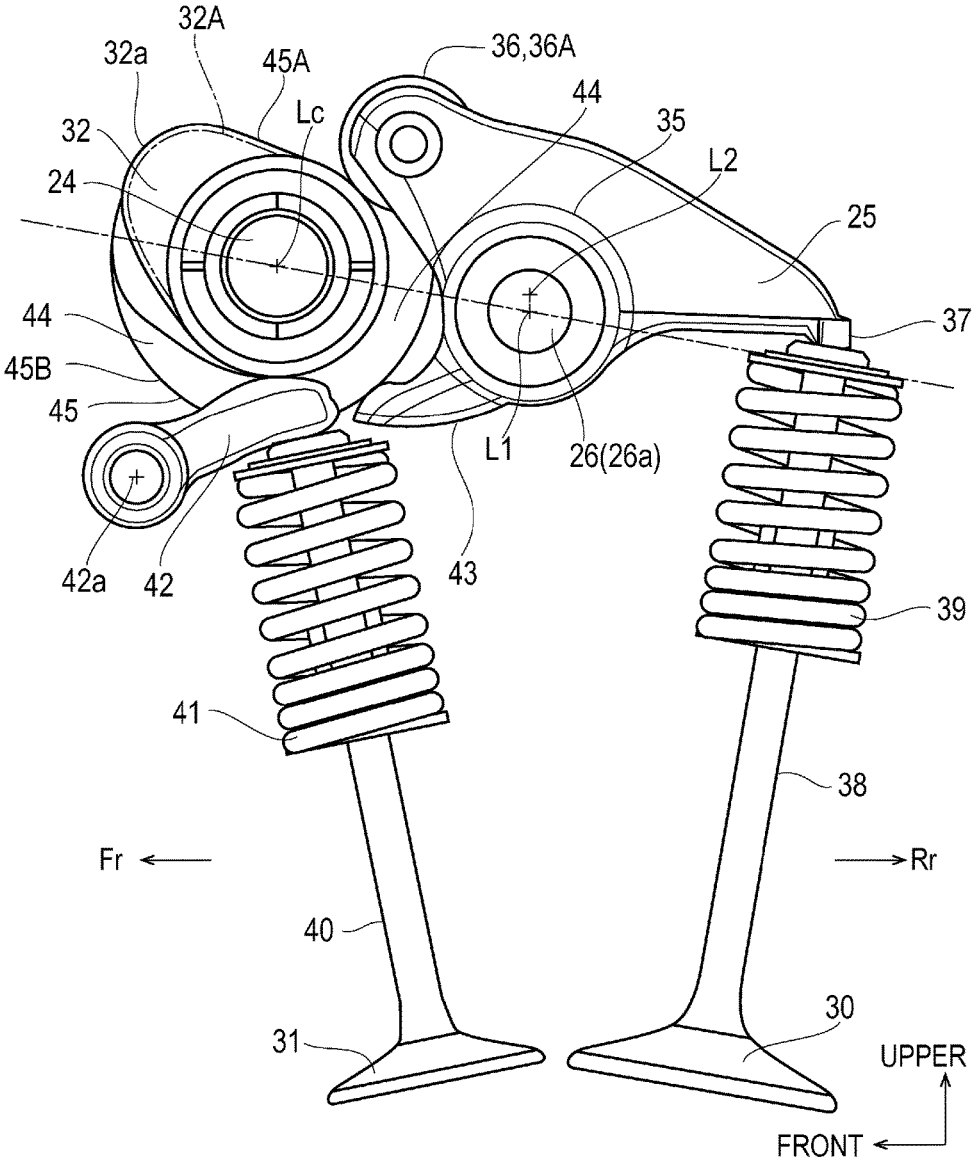
FIG. 8 is a side view illustrating a main part according to the overhead valve actuation mechanism of the present invention.

In this case, as illustrated in FIG. 8, the slipper 43 is disposed in an opposite side of the contact portion 36 of the rocker arms 25 by interposing a virtual line that connects a rotation axis L1 of the rocker arms 25 and a camshaft central axis Lc as viewed from the rotation axis direction of the rocker arm. In view of this, when the rocker arms 25 swing by the contact portion 36 being pressed by the air intake side valve cam 32, the slipper 43 comes close to the stopper cam 44.

The stopper cam 44 includes a stopper portion 45 as a swing restricting portion. The stopper portion 45 is formed on an outer peripheral surface of the stopper cam 44. The stopper portion 45 is a portion with which the slipper 43 comes in contact when the rocker arms 25 swing and reach a predetermined position, for example, when the rocker arms 25 swing over a maximum swing position that corresponds to a top portion 32*a* of the air intake side valve cam 32.

More specifically, the stopper portion 45 of the stopper cam 44 is formed to be a continuous surface such that an interval between the slipper 43 and the stopper portion 45 is kept within a predetermined range when the rocker arms 25 swing in a range of a cam lobe 32A (indicated by a one dot chain line in FIG. 8) including the top portion 32*a* of the air intake side valve cam 32.

The stopper portion 45 includes a first portion 45A and a second portion 45B. The first portion 45A corresponds to the cam lobe 32A of the air intake side valve cam 32. The second portion 45B corresponds to the range of the air intake side valve cam 32 other than the range of the cam lobe 32A. The second portion 45B is formed to be approximately circumferential. The first portion 45A is formed to be inside the circumference of the second portion 45B and have a minimum radius at a position that corresponds to the top portion 32*a* of the air intake side valve cam 32.

In the case of above, the stopper portion 45 is disposed around a whole circumference of the stopper cam 44, and the interval between the slipper 43 and the stopper portion 45 is formed so as to be kept within the predetermined range at every rotation position of the rocker arm shaft 26 including when the rocker arms 25 do not swing.

As illustrated in FIG. 8, the slipper 43 is disposed in the opposite side of the contact portion 36, which receives the pressure from the air intake side valve cam 32, of the rocker arms 25 by interposing the virtual line that connects the rotation axis L1 of the rocker arms 25 and the camshaft central axis Lc as viewed from the rotation axis direction of the rocker arm. Thus separately disposing the slipper 43 and the contact portion 36, which are formed to project to the camshaft avoids interference with one another and improves a freedom of designing the interval between the slipper 43 and the stopper portion 45.

In this example, the slipper 43 is disposed on the rocker arms 25 in the air intake side. Typically, the intake valve 30 is large in size compared with the exhaust valve 31, and a weight of valve movable parts in the air intake side is larger than those in the air exhaust side. Accordingly, the air intake side is easily susceptible to the inertia force. However, disposing the above-described slipper on this rocker arm in the air intake side ensures reducing this influence of the inertia force.

In the overhead valve actuation mechanism 23 of the present invention, especially, only one camshaft 24 is disposed within one cylinder head 13, and an axial center of this camshaft 24 is biased to the exhaust valve 31 side with respect to the cylinder axis line Z as viewed from the axial direction of the camshaft 24 as illustrated in FIG. 4.

Here, as illustrated in FIG. 4, an angle between the intake valve 30 and the exhaust valve 31 is a valve included angle θ. The valve included angle θ is a sum of an inclination angle α of an axis line Li of the intake valve 30 (the intake valve stem 38) with respect to the cylinder axis line Z and an inclination angle β of an axis line Le of the exhaust valve 31 (the exhaust valve stem 40) with respect to the cylinder axis line Z. Here, in this example, it is formed to be $\alpha<\beta$, that is, the inclination angle of the axis line Li of the intake valve 30 is formed to be small and come close to the cylinder axis line Z compared with the axis line Le of the exhaust valve 31.

The camshaft 24 is disposed with its whole body positioning in the exhaust valve 31 side with respect to the cylinder axis line Z.

As illustrated in FIG. 4, the camshaft 24 is disposed with a part of the camshaft 24 overlapping with respect to the axis line Le of the exhaust valve 31 as viewed from the axial direction of the camshaft 24.

The overhead valve actuation mechanism 23 of the present invention includes the rocker arms 25 that act on the intake valves 30 to open and close via the air intake side valve cam 32 from the camshaft 24 and the rocker arm shaft 26 that rotatably supports these rocker arms 25.

In this case, the rocker arms 25 include, by interposing the cylinder axis line Z in between, the pressing portions 37, which are operating portions relative to the intake valves 30, in the air intake side and the contact portion 36 with the air intake side valve cam 32 in the air exhaust side.

The rocker arms 25 have the axis center of the rocker arm shaft 26 biased to the exhaust valve 31 side with respect to the cylinder axis line Z as viewed from the axial direction of the rocker arms 25.

Furthermore, the overhead valve actuation mechanism 23 of the present invention can include a supporting structure of the rocker arms 25 in which the rotation axis of the rocker arms 25 parallelly and slightly separates with respect to the center axis line of the fixed shaft portions 26*a* on the cylinder head side of the rocker arm shaft 26.

Figure 10:
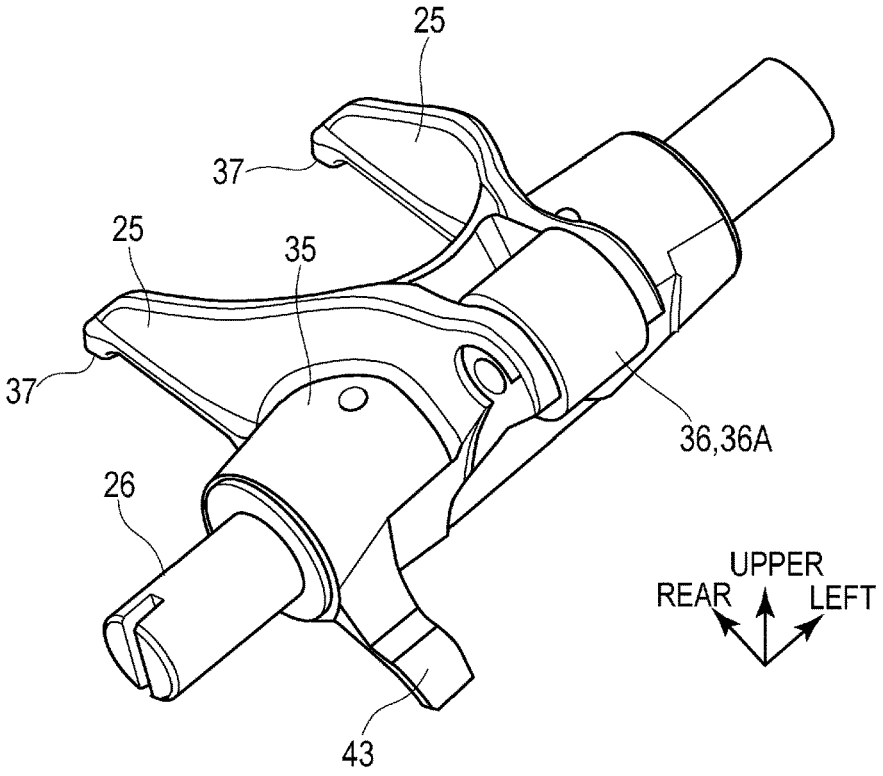
FIG. 10 is an upward perspective view illustrating a main part according to the overhead valve actuation mechanism of the present invention.
Figure 11:
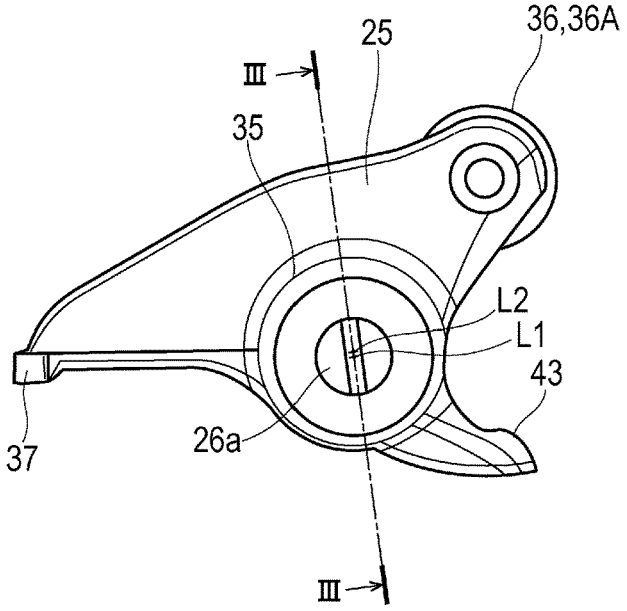
FIG. 11 is a side view illustrating a main part according to the overhead valve actuation mechanism of the present invention.

FIG. 10 is a perspective view illustrating the rocker arm shaft 26 that rotatably supports the rocker arm 25 and the rocker arm 25. FIG. 11 is a side view viewed from the axial direction of the rocker arm shaft 26. Here, as illustrated in FIG. 11, the rocker arm shaft 26 is formed such that the center axis line L1 of the fixed shaft portions 26*a* on the cylinder head side and the rotation axis L2 of the rocker arms 25 slightly separates upward.

Figure 13:
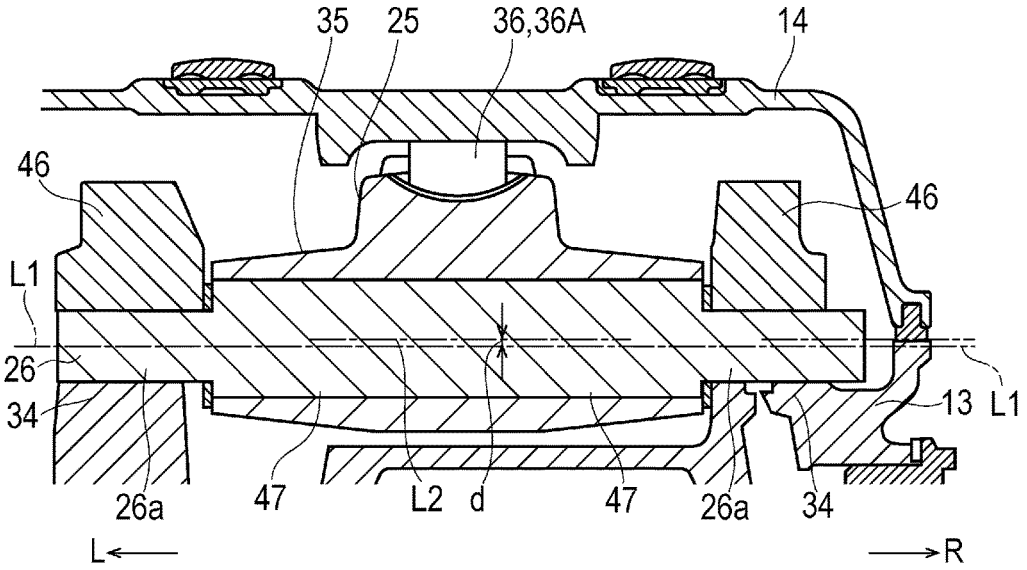
FIG. 13 is a cross-sectional view taken along a line III-III in FIG. 11 illustrating around a supporting structure of the rocker arm according to the present invention.

FIG. 13 is a cross-sectional view taken along a line III-III in FIG. 11 that illustrates around the supporting structure of the rocker arms 25. Both ends of the rocker arm shaft 26 are supported by the journal portions 34 and fastened and secured with caps 46 covering the journal portions 34 from above.

The pivot portion 35 of the rocker arms 25 is rotatably journaled by a pair of supporting portions 47 disposed in the rocker arm shaft 26.

The supporting portions 47 are formed such that the rotation axis L2 of the rocker arms 25 parallelly and slightly separates (shifts) upward with respect to the center axis line L1 of the fixed shaft portions 26*a* of the rocker arm shaft 26. In this case, the rotation axis L2 of the rocker arms 25 is eccentric with respect to the center axis line L1 of the fixed shaft portions 26*a* of the rocker arm shaft 26 as viewed from the axial direction of the rocker arm shaft 26. Accordingly, the rocker arm shaft 26 has, what is called an "eccentric supporting structure" in the supporting portion of the rocker arms 25.

Figure 12:
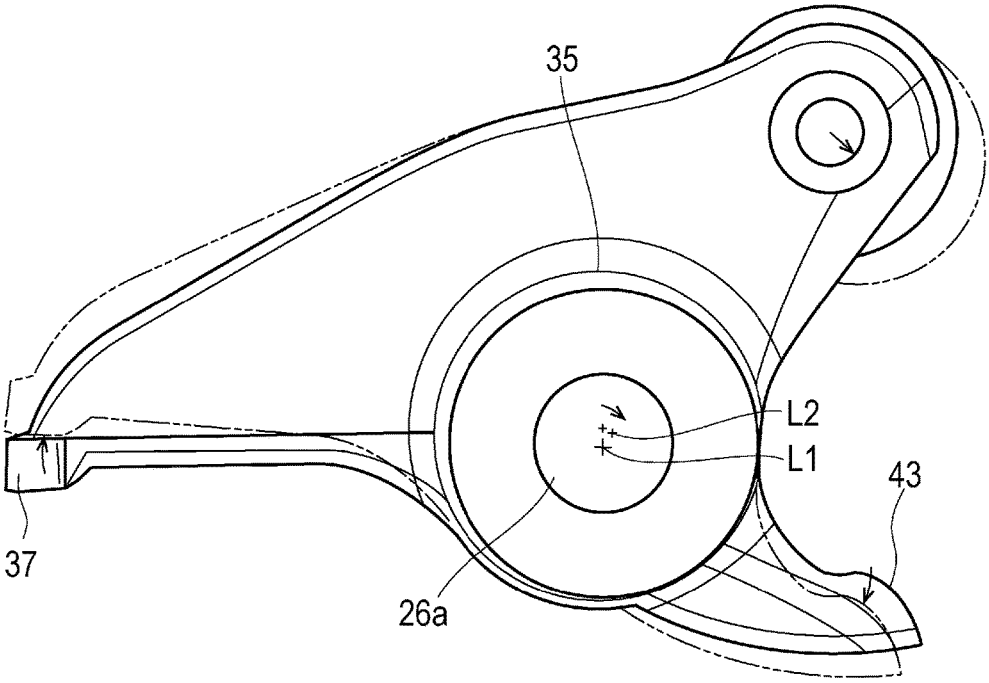
FIG. 12 is a side view illustrating an operation of a rocker arm according to the present invention.

A shifting direction of the rotation axis L2 with respect to the center axis line L1 is adjustable as necessary by changing a fixed state (position and posture) of the rocker arm shaft 26 to the cylinder head 13. For example, as illustrated in FIGS. 10 and 11, the fixed shaft portion 26*a* of the rocker arm shaft 26 is configured to rotate on the journal portion 34 of the cylinder head 13 and a groove 26*b* is disposed at one shaft end portion of the rocker arm shaft 26. Inserting a tool in the groove 26*b* and rotating about the center axis line L1 rotatably moves the rotation axis L2 of the rocker arms 25 about the center axis line L1. In association with this, the pivot portion 35, the contact portion 36, the pressing portions 37, and the slipper 43 of the rocker arms 25 also rotatably move about the center axis line L1 (see FIG. 12). Such structure that performs adjustment by rotating the rocker arm shaft 26 ensures easy adjustment even in a state where the rocker arm shaft 26 is supported by the cylinder head 13.

Figure 14:
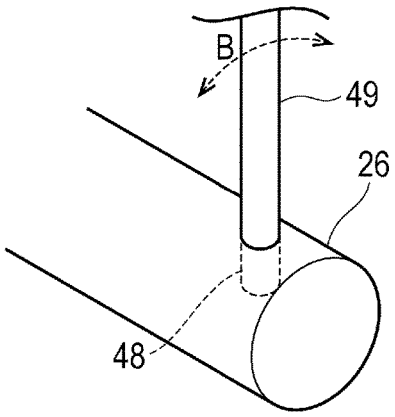
FIG. 14 is a perspective view illustrating an exemplary shifting adjustment method of the rocker arm according to the present invention.

Alternatively, as illustrated in FIG. 14, a structure may form an adjustment hole 48 at the shaft end portion of the rocker arm shaft 26 in the radial direction and include an adjuster 49 that is insertable into this adjustment hole 48. Appropriately turning the adjuster 49 inserted into the adjustment hole 48 as an arrow B illustrated in FIG. 14 can adjust the shifting direction of the rotation axis L2 with respect to the center axis line L1.

Next, main operational effects of the overhead valve actuation mechanism 23 of the present invention will be described. In this example, as described above, the slipper 43 is disposed on the rocker arms 25, and the stopper cam 44 including the stopper portion 45 as the swing restricting portion of the rocker arms 25 is disposed in the position opposing the slipper 43 in the camshaft 24 side.

This structure regulates further swinging of the rocker arms 25 by the slipper 43 of the rocker arms 25 and the stopper portion 45 coming in contact when what is called a valve jump is generated, to prevent the valve jump from becoming excessively large. The valve jump is a phenomenon in which the rocker arms 25 separate from the cam lobe of the air intake side valve cam 32 due to the inertia force of movable parts (such as the rocker arms 25) of a valve mechanism, that is, the overhead valve actuation mechanism 23 becoming larger than the reactive force received from the intake valve springs 39 during a high rotation of the engine 10.

This structure regulates a movement so as not to let the rocker arms 25 excessively jump by the slipper 43 coming in contact with the first portion 45A of the stopper portion 45 when the rocker arms 25 and the air intake side valve cam 32 separate by a certain clearance or more, thereby keeping the jump within a slight range.

Figure 9A:
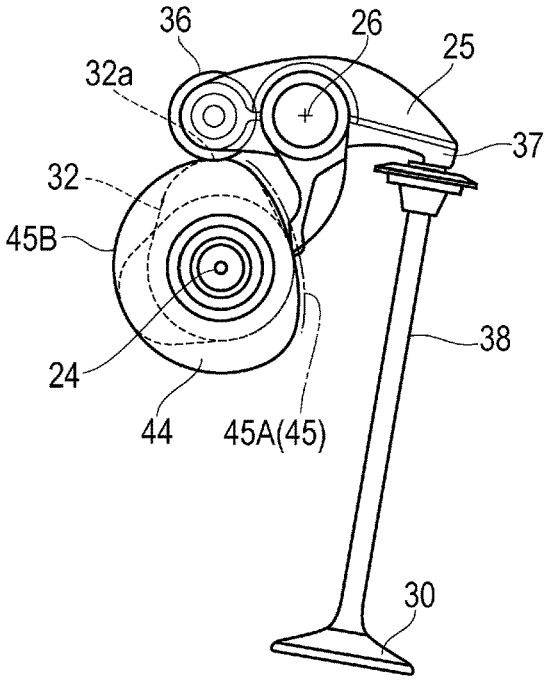
FIG. 9A is a side view illustrating an action according to the overhead valve actuation mechanism of the present invention.
Figure 9B:
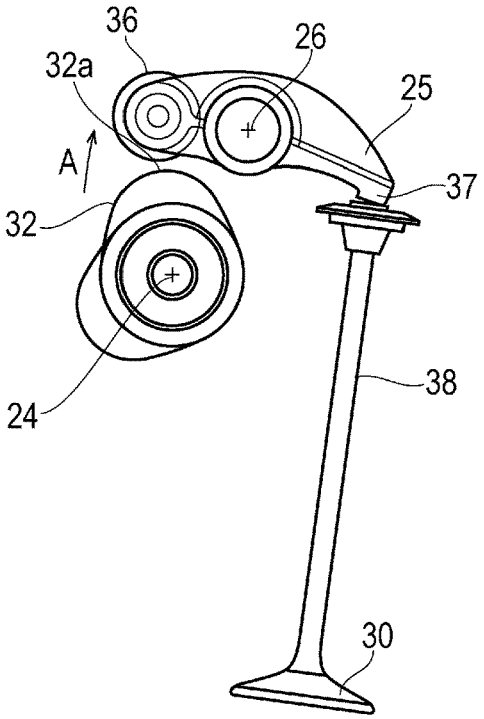
FIG. 9B is a side view illustrating an action of a conventional valve gear in comparison with the present invention.

Here, for the comparison, FIG. 9B illustrates the case where a conventional valve mechanism is applied (explanation is made using reference numerals identical to this example). Since the conventional valve mechanism does not originally include the slipper 43 and the stopper portion 45, when the above-described valve jump is generated, the rocker arms 25 excessively swings by the inertia force and makes a significant jump as an arrow A indicates. Therefore, there is a possibility that the inertia force causes unstable operation of the intake valves 30. In order to avoid this, it has been conventionally typical to design the maximum number of revolution of the engine 10 to be reduced to the extent where the valve jump is unlikely to be generated.

In contrast to this, in the present invention, the slipper 43 of the rocker arms 25 and the stopper cam 44 in which the stopper portion 45 is formed are disposed to restrain the rocker arms 25 from making an excessive jump in its course. This can substantially make the inertia mass of the rocker arms 25 that is subsequently applied to the intake valves 30 zero (0). In view of this, the inertia force from the rocker arms 25 that affects the intake valves 30 in opening and closing is reduced, thereby further stable valve actuation is ensured even when the engine 10 is in a high revolution.

Therefore, the range of revolution number of the engine 10 in which the valve gear can properly operate expands to a side of the high-revolution, thereby ensuring the engine with a further high revolution.

Even in the case where the number of revolutions of the engine 10 rises and a jump amount increases in the conventional structure, the jump amount can be reduced to a certain amount or less, thereby reducing an impact that the intake valves 30 receive from the valve seats of the cylinder head 13 to small when closing. Similarly, the rocker arms 25 that are retreated by the intake valves 30 gently abuts on the air intake side valve cam 32 when retreating, thereby also reducing an impact to the air intake side valve cam 32 to small.

Here, in this example, the stopper cam 44 including the stopper portion 45 is integrally formed with the camshaft 24. In view of this, the slipper 43 and the stopper portion 45 position at a midpoint between the rocker arms 25 and the camshaft 24, thus keeping the mechanism compact. Since the stopper portion 45 coordinates with the camshaft 24, the interval between the slipper 43 and the stopper portion 45 can be properly kept in association with swinging of the rocker arms 25.

Furthermore, the stopper portion 45 of the stopper cam 44 is formed to be a continuous surface such that the interval between the slipper 43 and the stopper portion 45 is kept within a predetermined range when the rocker arms 25 swing in a range of the cam lobe 32A (indicated by the one dot chain line in FIG. 8) including the top portion 32*a* of the air intake side valve cam 32. In view of this, the slipper 43 and the stopper portion 45 are constantly close when the rocker arms 25 swing. Therefore, the jump can be reliably restrained even at a swinging position other than the maximum swing and a further stable valve actuation is possible.

More preferably, the stopper portion 45 is formed to be a continuous surface such that the interval between the slipper 43 and the stopper portion 45 is kept within a predetermined range at every rotation position of the rocker arm shaft 26 including when the rocker arms 25 do not swing. In view of this, jumping of the rocker arms 25 can be restrained all the time.

In this example, the slipper 43 is disposed on the rocker arms 25 in the air intake side. Typically, the intake valve 30 is large in size compared with the exhaust valve 31, and the weight of valve movable parts in the air intake side is larger than those in the air exhaust side. Accordingly, the air intake side is easily susceptible to the inertia force compared with the air exhaust side, thereby reducing the operational limit number of revolutions of the valve mechanism. However, this example restrains the influence of the inertia force of the air intake side valve drive parts by disposing the above-described slipper 43 on the rocker arms 25 in the air intake side and regulating the excessive swing. In view of this, the proper operational number of revolutions of the valve mechanism can be effectively increased.

While the present invention has been described using various embodiments above, the present invention is not limited only to these embodiments. Changes and similar modification are possible within the scope of the present invention.

While the embodiment of the present invention has described the example where the camshaft 24 is arranged in the air exhaust side, the present invention is applicable to the case where the camshaft 24 is disposed in the air intake side.

The present invention is also effectively applicable to the case where the camshaft is disposed in an appropriate position in an intermediate position between the air intake side and the air exhaust side, and an operational advantage similar to this embodiment is obtainable.

According to the present invention, a slipper comes in contact with a stopper portion of a stopper cam to regulate a movement of a rocker arm with the slipper. In view of this, a jump of the rocker arm can be effectively restrained. This ensures a proper operation of a valve gear.

What is claimed is:

1. An overhead valve actuation mechanism for an engine, comprising:

a cylinder head;

a camshaft rotatably supported by the cylinder head, the camshaft including one or a plurality of valve cams, the camshaft operating opening and closing of an air intake side or air exhaust side valve via the valve cam;

a rocker arm swung by the valve cam of the camshaft, the rocker arm acting on the valve to open and close the valve; and a rocker arm shaft supported by the cylinder head, the rocker arm shaft swingably supporting the rocker arm, wherein the rocker arm includes:

a pivot portion that is journaled by the rocker arm shaft and serves as a swing center;

a contact portion that receives a pressure from the valve cam;

a pressing portion that projects to a side of the valve to press the valve in swinging; and a slipper formed to project outward from the rocker arm, and the overhead valve actuation mechanism for the engine includes a stopper portion with which the slipper comes in contact when the rocker arm swings and reaches a predetermined position at a position opposing the slipper, the stopper portion being disposed on the camshaft so as to integrally rotate.

2. The overhead valve actuation mechanism for the engine according to claim 1, wherein the stopper portion is formed so as to come in contact with the slipper when the rocker arm is at a swing position exceeding a maximum swing position that corresponds to a top portion of the valve cam.

3. The overhead valve actuation mechanism for the engine according to claim 2, wherein the stopper portion is formed so as to keep an interval between the slipper and the stopper portion within a predetermined range when the rocker arm swings in a range of a cam lobe including the top portion of the valve cam.

4. The overhead valve actuation mechanism for the engine according to claim 1, wherein:

the slipper is formed so as to project toward a side of the camshaft, and the camshaft includes a stopper cam in which the stopper portion is disposed at a position opposing the slipper.

5. The overhead valve actuation mechanism for the engine according to claim 4, wherein the stopper portion is disposed around a whole circumference of the stopper cam and formed so as to keep the interval between the slipper and the stopper portion within a predetermined range.

6. The overhead valve actuation mechanism for the engine according to claim 1, wherein the slipper is disposed on the rocker arm that opens and closes the air intake side valve.

7. An overhead valve actuation mechanism for an engine, comprising:

a cylinder head;

a camshaft rotatably supported by the cylinder head, the camshaft including one or a plurality of valve cams, the camshaft operating opening and closing of an air intake side or air exhaust side valve via the valve cam;

a rocker arm swung by the valve cam of the camshaft, the rocker arm acting on the valve to open and close the valve; and a rocker arm shaft supported by the cylinder head, the rocker arm shaft swingably supporting the rocker arm, wherein the rocker arm includes:

a pivot portion that is journaled by the rocker arm shaft and serves as a swing center;

a contact portion that receives a pressure from the valve cam;

a pressing portion that projects to a side of the valve to press the valve in swinging; and a slipper formed to project outward from the rocker arm, and the overhead valve actuation mechanism for the engine includes a stopper portion with which the slipper comes in contact when the rocker arm swings and reaches a predetermined position at a position opposing the slipper, the slipper being disposed in an opposite side of the contact portion by interposing a virtual line that connects a rotation axis of the rocker arm and a central axis of the camshaft as viewed from a rotation axis direction of the rocker arm.

8. An overhead valve actuation mechanism for an engine, comprising:

a cylinder head;

a camshaft rotatably supported by the cylinder head, the camshaft including one or a plurality of valve cams, the camshaft operating opening and closing of an air intake side or air exhaust side valve via the valve cam;

a rocker arm swung by the valve cam of the camshaft, the rocker arm acting on the valve to open and close the valve; and a rocker arm shaft supported by the cylinder head, the rocker arm shaft swingably supporting the rocker arm, wherein the rocker arm includes:

a pivot portion that is journaled by the rocker arm shaft and serves as a swing center;

a contact portion that receives a pressure from the valve cam;

a pressing portion that projects to a side of the valve to press the valve in swinging; and a slipper formed to project outward from the rocker arm, and the overhead valve actuation mechanism for the engine includes a stopper portion with which the slipper comes in contact when the rocker arm swings and reaches a predetermined position at a position opposing the slipper, the slipper being disposed in a side closer to a combustion chamber with respect to a rotation axis of the rocker arm.

* * * * *